US012606407B2

(12) United States Patent
Inaba et al.

(10) Patent No.: US 12,606,407 B2
(45) Date of Patent: Apr. 21, 2026

(54) RECORDING MEDIUM PROCESSING APPARATUS AND IMAGE FORMING SYSTEM

(71) Applicant: FUJIFILM Business Innovation Corp., Tokyo (JP)

(72) Inventors: Nobuhide Inaba, Kanagawa (JP); Kumiko Tanaka, Kanagawa (JP); Takashi Ogino, Kanagawa (JP); Koji Udagawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 18/189,218

(22) Filed: Mar. 24, 2023

(65) Prior Publication Data

US 2024/0025691 A1 Jan. 25, 2024

(30) Foreign Application Priority Data

Jul. 25, 2022 (JP) ..... 2022-118138

(51) Int. Cl.
*B65H 37/04* (2006.01)

(52) U.S. Cl.
CPC ..... *B65H 37/04* (2013.01); *B65H 2301/5142* (2013.01); *B65H 2301/5161* (2013.01); *B65H 2801/27* (2013.01)

(58) Field of Classification Search
CPC ..... B65H 37/04; B65H 2301/5142; B65H 2301/5161; B65H 2301/5162; B65H 2301/51616; B65H 2301/43828; B65H 2801/27; B31F 5/02; B31F 2201/0754; B31F 2201/0771; B31F 2201/0784; G03G 15/6541; G03G 15/6544; G03G 2215/00848; G03G 2215/00852
USPC ..... 270/58.08
See application file for complete search history.

(56) References Cited

U.S. PATENT DOCUMENTS 10,759,135 B2 * 9/2020 Takahashi ..... B42B 5/00

FOREIGN PATENT DOCUMENTS

| | | | | |
|---|---|---|---|---|
| JP | 2014201432 | | 10/2014 | |
| JP | 2015127116 | | 7/2015 | |
| JP | 2017013930 A | * | 1/2017 | |
| WO | WO-2021183175 A1 | * | 9/2021 | ..... B42B 5/00 |

OTHER PUBLICATIONS

Espacenet machine translation of JP2017013930A; https://translationportal.epo.org/emtp/translate/?ACTION=description-retrieval&COUNTRY=JP&ENGINE=google&FORMAT=docdb&KIND=A&LOCALE=en_EP&NUMBER=2017013930&OPS=ops.epo.org/3.2&SRCLANG=ja&TRGLANG=en (Year: 2017).*

* cited by examiner

*Primary Examiner* — Leslie A Nicholson, III
(74) *Attorney, Agent, or Firm* — JCIPRNET

(57) ABSTRACT

A recording medium processing apparatus includes: a binder that performs a binding process on a recording medium; and a moisture supplier that supplies moisture in a form of mist to a binding portion of the recording medium, the binding portion being a portion subjected to the binding process performed by the binder.

19 Claims, 10 Drawing Sheets

RECORDING MEDIUM PROCESSING APPARATUS AND IMAGE FORMING SYSTEM

CROSS-REFERENCE TO RELATED APPLICATIONS

This application is based on and claims priority under 35 USC 119 from Japanese Patent Application No. 2022-118138 filed Jul. 25, 2022.

BACKGROUND

(i) Technical Field

The present disclosure relates to a recording medium processing apparatus and an image forming system.

(ii) Related Art

Japanese Unexamined Patent Application Publication No. 2014-201432 describes a sheet post-processing device including a water adding unit that applies moisture to a paper sheet in a binding region and a controller that changes and adjusts an amount of moisture that is applied.

Japanese Unexamined Patent Application Publication No. 2015-127116 describes a moisture supplier that supplies moisture to an edge portion of a stack of paper sheets placed on a staple tray and aligned by a sheet stack aligner at edges thereof in a sheet transporting direction and a sheet width direction.

SUMMARY

In a process of binding recording media together, the binding strength may be increased by causing moisture to penetrate into the recording media.

The degree of penetration of the moisture into the recording media may be increased by, for example, adding a surface active agent or the like to the moisture to modify the moisture. In such a case, the device structure may become more complex, and the operator's workload may be increased.

Aspects of non-limiting embodiments of the present disclosure relate to a technique for increasing the degree of penetration of moisture supplied to a recording medium into the recording medium without necessarily modifying the moisture that is supplied.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a recording medium processing apparatus including: a binder that performs a binding process on a recording medium; and a moisture supplier that supplies moisture in a form of mist to a binding portion of the recording medium, the binding portion being a portion subjected to the binding process performed by the binder.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will now be described with reference to the accompanying drawings.

Figure 1:
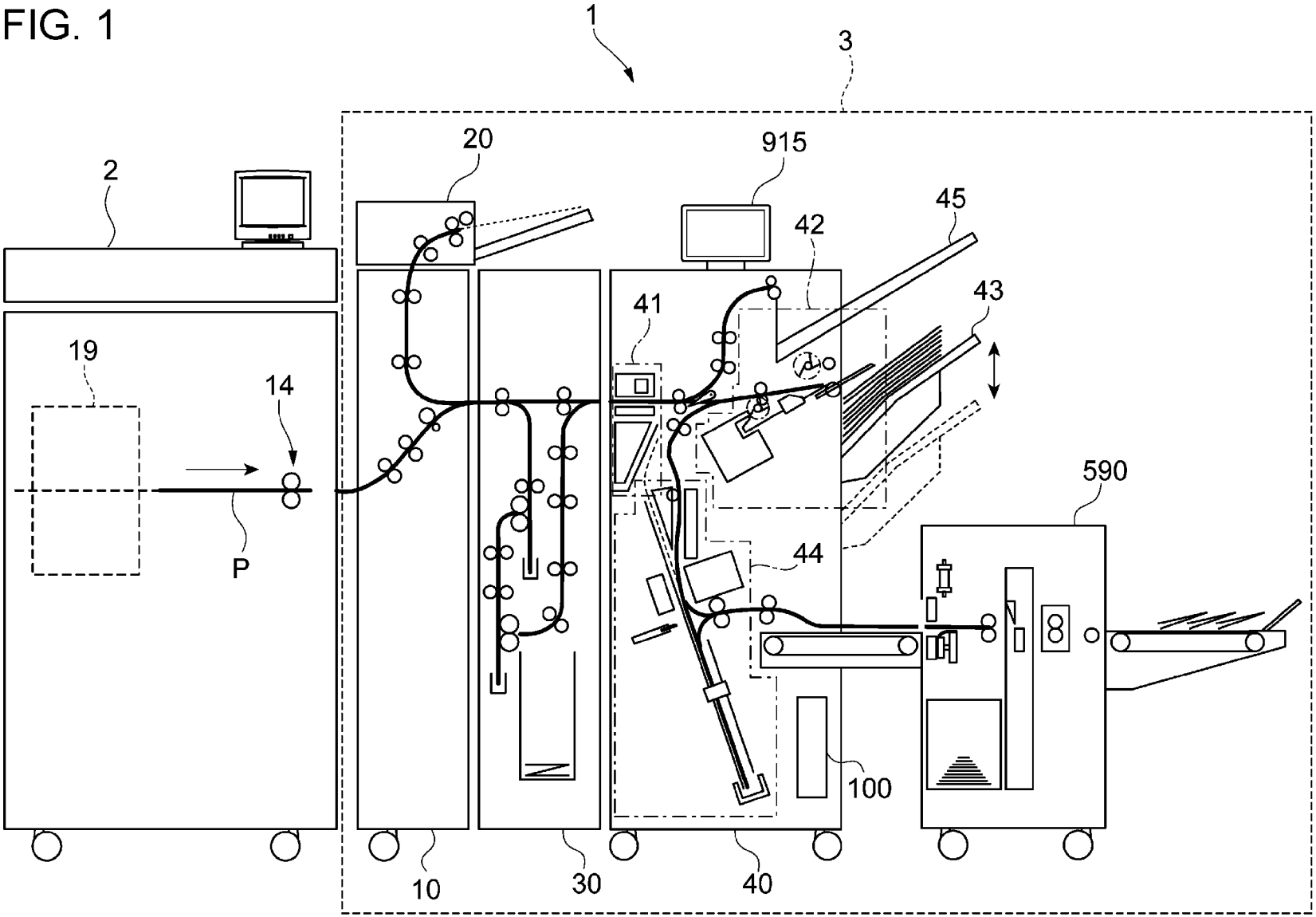
FIG. 1 illustrates the overall structure of an image forming system.

FIG. 1 illustrates the overall structure of an image forming system 1.

The image forming system 1 illustrated in FIG. 1 includes an image forming apparatus 2 that forms an image on a paper sheet P, which is an example of a recording medium, and a sheet processing apparatus 3 that performs a predetermined process on the paper sheet P having the image formed thereon by the image forming apparatus 2.

The image forming apparatus 2 includes an image forming unit 19 that forms the image on the paper sheet P by an electrophotographic system or an inkjet system.

The image forming apparatus 2 also includes a fixing device 14. The fixing device 14 is disposed downstream of the image forming unit 19 in a transport direction in which the paper sheet P is transported.

The fixing device 14 applies heat and pressure to the paper sheet P on which the image is formed. Thus, the image on the paper sheet P is fixed to the paper sheet P.

The sheet processing apparatus 3, which is an example of a recording medium processing apparatus, includes a transport device 10 that transports the paper sheet P output from the image forming apparatus 2 toward a downstream location and a joining-sheet supplying device 20 that supplies a joining sheet, such as a cardboard or a paper sheet P having a window, to the paper sheet P transported by the transport device 10.

The sheet processing apparatus 3 also includes a folding device 30 that performs a process of folding the paper sheet P transported from the transport device 10 into, for example, an inward trifold (C fold) or an outward trifold (Z fold).

The sheet processing apparatus 3 also includes a first post-processing device 40 that is disposed downstream of the folding device 30 and performs, for example, a hole punching process, an edge binding process, or a saddle stitch binding process on the paper sheet P.

More specifically, the first post-processing device 40 disposed downstream of the folding device 30 performs a process on a sheet stack including plural paper sheets P on which images are formed by the image forming apparatus 2 or on each of the paper sheets P individually.

The sheet processing apparatus 3 also includes a second post-processing device 590 that is disposed downstream of the first post-processing device 40 and that performs an additional process on a half-folded or saddle-stitch-bound sheet stack.

The sheet processing apparatus 3 also includes an information processing unit 100 including a central processing unit (CPU) that performs programs, and the overall operation of the sheet processing apparatus 3 is controlled by the information processing unit 100.

The sheet processing apparatus 3 also includes an information display unit 915 that is composed of, for example, a liquid crystal monitor and that displays information to be presented to a user.

The first post-processing device 40 includes a punching unit 41 that forms (punches) holes in the paper sheets P and an edge binding unit 42 that binds the sheet stack together at an edge of the sheet stack.

The paper sheets P processed by the edge binding unit 42 are stacked on a first stacking portion 43, and the paper sheets P that are not processed by the first post-processing device 40 or the paper sheets P subjected only to the hole punching process are stacked on a second stacking portion 45.

The first post-processing device 40 also includes a saddle stitch binding unit 44 that performs a half folding/saddle stitch binding process on the sheet stack to form a booklet.

Figure 2:
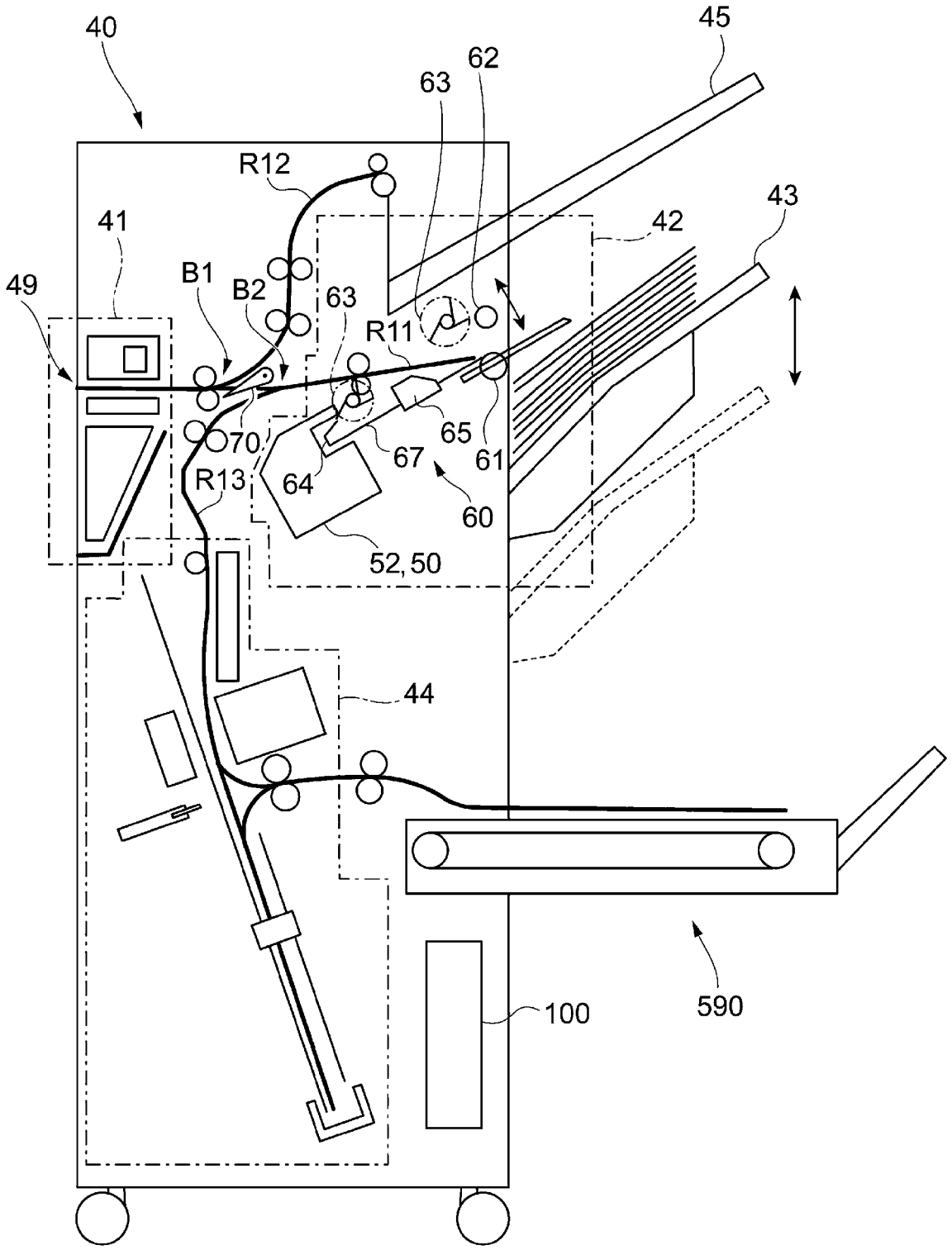
FIG. 2 illustrates the structure of a first post-processing device.

FIG. 2 illustrates the structure of the first post-processing device 40.

The first post-processing device 40 has an inlet 49 through which each paper sheet P transported from the folding device 30 is received.

A punching unit 41 is disposed immediately behind the inlet 49. In the punching unit 41, two or four holes, for example, are formed (punched) in the paper sheet P transported to the first post-processing device 40.

A first sheet transport path R11, which extends from the inlet 49 to the edge binding unit 42, is used to transport the paper sheet P received through the inlet 49 to the edge binding unit 42.

A second sheet transport path R12, which branches from the first sheet transport path R11 at a first branching point B1, is used to transport the paper sheet P to the second stacking portion 45.

A third sheet transport path R13, which branches from the first sheet transport path R11 at a second branching point B2, is used to transport the paper sheet P to the saddle stitch binding unit 44.

The path along which the paper sheet P is to be transported is set to one of the first sheet transport path R11 to the third sheet transport path R13 by a switching gate 70.

The edge binding unit 42 includes a sheet accumulating unit 60 that accumulates a predetermined number of paper sheets P to form a sheet stack.

The sheet accumulating unit 60 includes a support plate 67 that is inclined with respect to a horizontal direction and that supports the paper sheets P transported thereto from below. In the present exemplary embodiment, a sheet stack is formed on the support plate 67.

The edge binding unit 42 also includes a binder unit 50 that performs a binding (edge binding) process on an edge portion of the sheet stack formed by the sheet accumulating unit 60.

In the present exemplary embodiment, the binder unit 50 is constituted by a binder unit 52 that performs the binding process without using staples.

The edge binding unit 42 also includes a transport roller 61 that rotates to feed the sheet stack formed by the sheet accumulating unit 60 to the first stacking portion 43. The edge binding unit 42 also includes a movable roller 62 that is movable between a position at which the movable roller 62 is separated from the transport roller 61 and a position at which the movable roller 62 is pressed against the transport roller 61.

In the process performed by the edge binding unit 42, first, a paper sheet P that is transported is received through the inlet 49.

Then, the paper sheet P is transported along the first sheet transport path R11 and reaches the edge binding unit 42.

The paper sheet P is transported to a location above the support plate 67, and then falls onto the support plate 67. The paper sheet P is supported by the support plate 67 from below, and is caused to slide along the support plate 67 due to the inclination of the support plate 67 and by a rotating member 63.

After that, the paper sheet P comes into contact with an end guide 64 attached to an end portion of the support plate 67. More specifically, in the present exemplary embodiment, the end guide 64, which extends upward in FIG. 2, is provided on the end portion of the support plate 67, and the paper sheet P that slides along the support plate 67 comes into contact with the end guide 64.

Thus, in the present exemplary embodiment, the movement of the paper sheet P is stopped. The above-described operation is performed each time a paper sheet P is transported from an upstream location, so that a sheet stack in which plural paper sheets P are aligned is provided on the support plate 67.

In addition, in the present exemplary embodiment, an aligning member 65 is provided to align the positions of the paper sheets P of the sheet stack in the width direction.

In the present exemplary embodiment, the aligning member 65 presses an edge portion (side portion) of each paper sheet P in the width direction when the paper sheet P is supplied to the support plate 67, and thereby aligns the positions of the paper sheets P (position of the sheet stack) in the width direction.

When a predetermined number of paper sheets P are stacked on the support plate 67, the binder unit 52, which is an example of a binder, binds the edge portion of the sheet stack.

The binder unit 52 binds the sheet stack by clamping the sheet stack between two binding tools so that the paper sheets P included in the sheet stack are compressed and bonded to each other.

After that, in the present exemplary embodiment, the movable roller 62 moves toward the transport roller 61 so that the sheet stack is held between the movable roller 62 and the transport roller 61. After that, the transport roller 61 rotates to transport the sheet stack to the first stacking portion 43.

The binder unit 52 is movable back and forth perpendicularly to the plane of FIG. 2, and is capable of performing a binding process on the paper sheets P at plural locations in the present exemplary embodiment.

The section in which the edge binding unit 42 is provided may be regarded as a binding device that binds the paper sheets P together.

In the present exemplary embodiment, when edges of the paper sheets P are to be bound together, the paper sheets P are transported to the edge binding unit 42 after images are formed thereon by the image forming apparatus 2. The edge binding unit 42 performs the binding process on the paper sheets P transported from the image forming apparatus 2.

Figure 3:
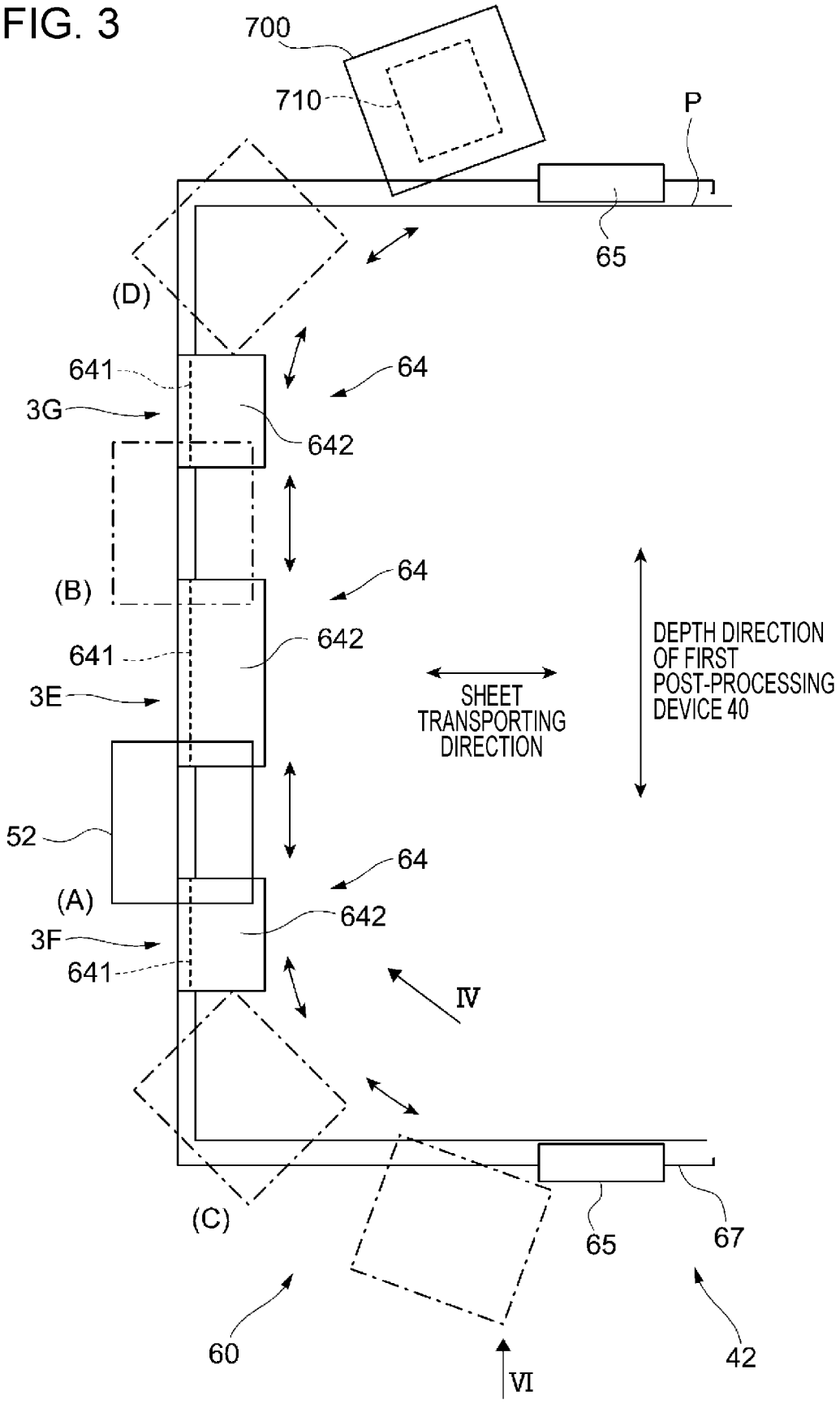
FIG. 3 is a top view of a sheet accumulating unit.

Referring to FIG. 3, which is a top view of the sheet accumulating unit 60, the binder unit 52 is provided in the present exemplary embodiment as described above.

In the present exemplary embodiment, a moisture adjustment mechanism 700 is also provided as an example of a moisture adjustment unit that adjusts the amount of moisture contained in the paper sheets P accumulated by the sheet accumulating unit 60.

In the present exemplary embodiment, each time a paper sheet P is transported to the edge binding unit 42, the moisture adjustment mechanism 700 adjusts the amount of moisture as necessary. In other words, in the present exemplary embodiment, the moisture adjustment mechanism 700 adjusts the amount of moisture for each paper sheet P individually as necessary.

The adjustment of the amount of moisture is not limited to this, and the moisture adjustment mechanism 700 may adjust the amount of moisture after a sheet stack is formed.

The moisture adjustment mechanism 700, which is an example of a moisture adjustment unit, includes a moisture supplying unit 710.

The moisture supplying unit 710, which is an example of a moisture supplier, supplies moisture to the paper sheets P to be subjected to the binding process. More specifically, the moisture supplying unit 710 supplies moisture in the form of mist to a binding portion of each paper sheet P, the binding portion being a portion subjected to the binding process performed by the binder unit 52 that serves as a binder.

As long as moisture is supplied at least to the binding portion, moisture may also be supplied to regions surrounding the binding portion.

The moisture supplied to the paper sheets P is not limited to water, and may contain components other than water.

Although the moisture supplying unit 710 is movable in the present exemplary embodiment, the moisture supplying unit 710 may be fixed.

When the moisture supplying unit 710 is fixed, the moisture supplying unit 710 may be provided at, for example, each binding position at which the paper sheets P may be bound.

It is not necessary that moisture be supplied to the binding portion in the edge binding unit 42 (see FIG. 1), and moisture may be supplied in the image forming apparatus 2.

Alternatively, moisture may be supplied to the binding portion of each paper sheet P while, for example, the paper sheet P is being transported from the image forming apparatus 2 to the edge binding unit 42.

In other words, moisture may be supplied to the binding portion of the paper sheet P on the transport path along which the paper sheet P is transported toward the edge binding unit 42.

The binder unit 52 (see FIG. 3) and the moisture adjustment mechanism 700 are disposed at different positions in the depth direction of the first post-processing device 40.

In the present exemplary embodiment, the binder unit 52 and the moisture adjustment mechanism 700 move in the depth direction of the first post-processing device 40, which is a direction orthogonal to the transport direction in which the paper sheets P (sheet stack) are transported.

In the present exemplary embodiment, the binder unit 52 and the moisture adjustment mechanism 700 move along the same single path.

In the present exemplary embodiment, the binder unit 52 is movable and capable of performing the binding process on the sheet stack at plural locations.

In the present exemplary embodiment, the moisture adjustment mechanism 700 is movable and capable of supplying moisture to the sheet stack at plural positions.

The binder unit 52 may stop at, for example, two different positions (positions (A) and (B) in FIG. 3) in the depth direction of the first post-processing device 40 and perform the binding process at these two positions (two-point edge binding process).

The binder unit 52 may also stop at, for example, one end (one corner) of the sheet stack (position (D) in FIG. 3) and perform the binding process at this position (one-point edge binding).

The binder unit 52 may also stop at, for example, another end (another corner) of the sheet stack (position (C) in FIG. 3) and perform the binding process at this position (one-point edge binding).

The moisture adjustment mechanism 700 may stop at the above-described two positions (positions (A) and (B) in FIG. 3) and supply moisture at these two positions.

The moisture adjustment mechanism 700 may also stop at, for example, one end (one corner) of the sheet stack (position (D) in FIG. 3) and supply moisture at this position.

The moisture adjustment mechanism 700 may also stop at, for example, another end (another corner) of the sheet stack (position (C) in FIG. 3) and supply moisture at this position.

In the present exemplary embodiment, the binder unit 52 and the moisture adjustment mechanism 700 move linearly between positions (A) and (B).

In addition, in the present exemplary embodiment, each of the binder unit 52 and the moisture adjustment mechanism 700 rotates by 45°, for example, during movement between positions (A) and (C) and between positions (B) and (D).

When each of the binder unit 52 and the moisture adjustment mechanism 700 is moved, a drive source, such as a motor, may be provided thereon. In such a case, each of the binder unit 52 and the moisture adjustment mechanism 700 moves independently.

When the binder unit 52 and the moisture adjustment mechanism 700 are moved, the binder unit 52 and the moisture adjustment mechanism 700 are attached to, for example, respective movable belts. Then, these belts are moved. Accordingly, the binder unit 52 and the moisture adjustment mechanism 700 are moved.

In the present exemplary embodiment, as illustrated in FIG. 3, plural end guides 64 are provided.

These end guides 64 are disposed at different locations in the depth direction of the first post-processing device 40, which is a direction orthogonal to the transport direction of the paper sheets P.

As illustrated in FIG. 3, each end guide 64 includes a restricting portion 641 and a facing portion 642.

The restricting portion 641 is orthogonal to the support plate 67, and in the present exemplary embodiment, an edge portion of each paper sheet P comes into contact with the restricting portion 641 so that movement of the paper sheet P is restricted.

The facing portion 642 is connected to the restricting portion 641 and faces the support plate 67.

In the present exemplary embodiment, when a paper sheet P is placed on the support plate 67, an edge portion of the paper sheet P enters the space between the facing portion 642 and the support plate 67. Then, the edge portion of the paper sheet P comes into contact with the restricting portion 641. Thus, the paper sheet P is aligned.

When the binding process is performed at position (A) in FIG. 3, the binding process is performed in a gap between the facing portion 642 denoted by 3E disposed at a central position (central position in the vertical direction) in FIG. 3 and the facing portion 642 denoted by 3F disposed at a lower position in FIG. 3.

Similarly, when moisture is supplied at position (A) in FIG. 3, the moisture is supplied in the gap between the facing portion 642 denoted by 3E disposed at the central position in FIG. 3 and the facing portion 642 denoted by 3F disposed at the lower position in FIG. 3.

When the binding process is performed at position (B) in FIG. 3, the binding process is performed in a gap between the facing portion 642 denoted by 3G disposed at an upper position in FIG. 3 and the facing portion 642 denoted by 3E disposed at the central position in FIG. 3.

Similarly, when moisture is supplied at position (B) in FIG. 3, the moisture is supplied in the gap between the facing portion 642 denoted by 3G disposed at the upper position in FIG. 3 and the facing portion 642 denoted by 3E disposed at the central position in FIG. 3.

Although a binder unit that does not use binding members, such as staples, is used as the binder unit 52 in the present exemplary embodiment, a binder unit that uses binding members, such as stapes, may be additionally provided.

When a binder unit that uses binding members is additionally provided, the binder unit to be used may, for example, be switched in accordance with an instruction from the user.

In such a case, both a binding process using no binding members and a binding process using binding members may be performed.

Figure 4:
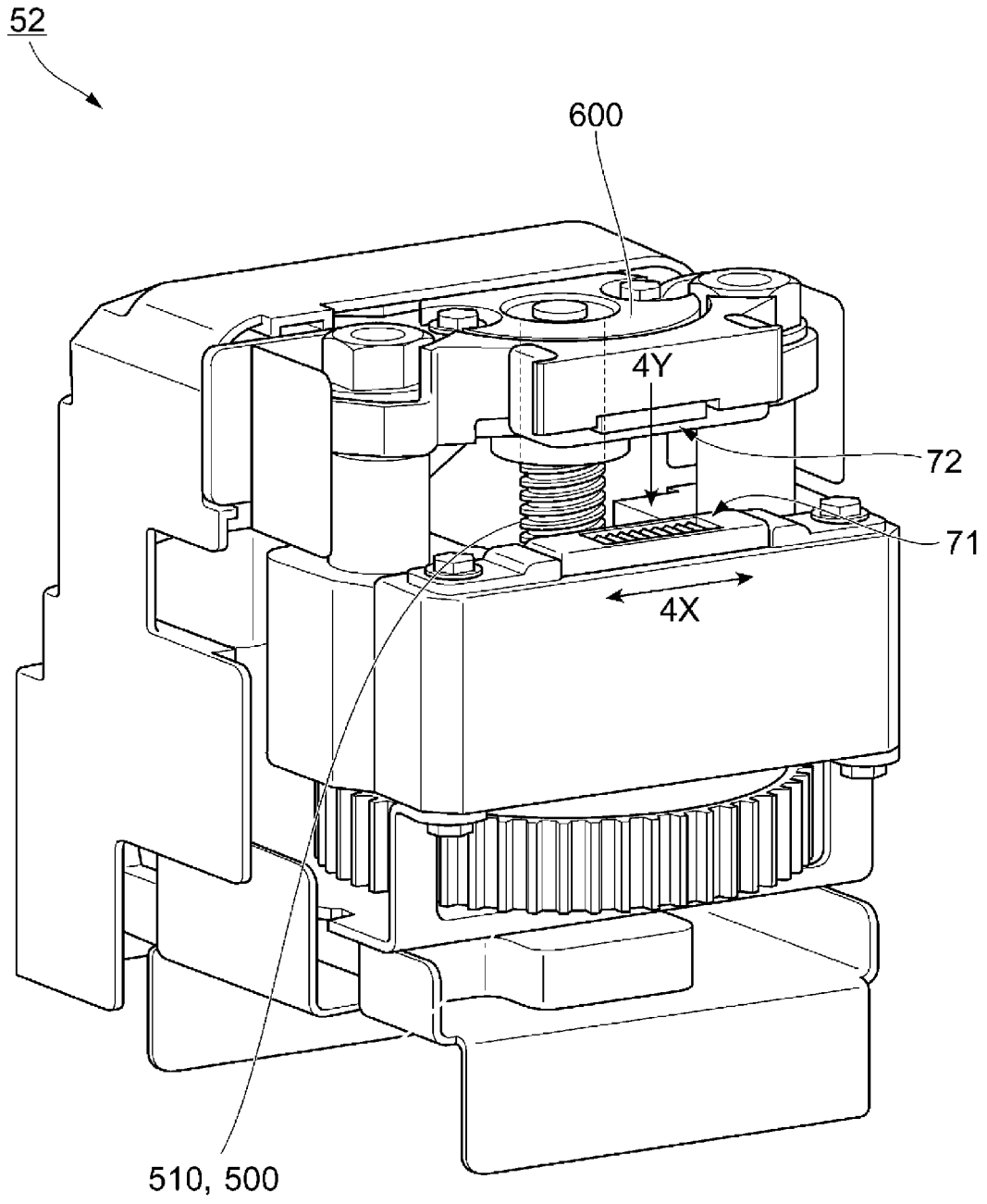
FIG. 4 illustrates a binder unit viewed in the direction of arrow IV in FIG. 3.

FIG. 4 illustrates the binder unit 52 viewed in the direction of arrow IV in FIG. 3.

The binder unit 52, which is an example of a binder, includes a first binding tool 71 used in the binding process for binding a sheet stack including plural paper sheets P.

A second binding tool 72 is disposed above the first binding tool 71.

Each of the first binding tool 71 and the second binding tool 72 has an irregular portion.

A surface of the first binding tool 71 that faces the second binding tool 72 and a surface of the second binding tool 72 that faces the first binding tool 71 each have the irregular portion in which projections and recesses are alternately arranged in the direction shown by arrow 4X in FIG. 4.

In other words, the surface of the first binding tool 71 that faces the second binding tool 72 and the surface of the second binding tool 72 that faces the first binding tool 71 each have the irregular portion in which projections and recesses are alternately arranged in a longitudinal direction of the first binding tool 71 and the second binding tool 72.

When the binding process is performed by the first binding tool 71 and the second binding tool 72, the second binding tool 72 moves toward the first binding tool 71.

More specifically, in the present exemplary embodiment, when the binding process is performed, the second binding tool 72 moves downward along a linear path shown by arrow 4Y in FIG. 4 toward the first binding tool 71.

Then, in the present exemplary embodiment, a sheet stack (not illustrated) disposed between the first binding tool 71 and the second binding tool 72 is pressed between the first binding tool 71 and the second binding tool 72.

At this time, in the present exemplary embodiment, the projections provided on the first binding tool 71 face the recesses provided on the second binding tool 72. Also, the recesses provided on the first binding tool 71 face the projections provided on the second binding tool 72.

The projections provided on each of the binding tools enter the recesses provided on the other of the binding tools.

Accordingly, the paper sheets P included in the sheet stack are compressed and bonded to each other, and thus the binding process is performed on the paper sheets P. After that, in the present exemplary embodiment, the second binding tool 72 moves upward away from the first binding tool 71.

Although the projections and the recesses are alternately arranged on each of the first binding tool 71 and the second binding tool 72 in the present exemplary embodiment, the arrangement of the projections and the recesses is not limited to this.

In other words, the structure illustrated in FIG. 4 is an example of the first binding tool 71 and the second binding tool 72; the first binding tool 71 and the second binding tool 72 are not limited to the structure illustrated in FIG. 4, and may have other structures.

The binder unit 52 includes a moving mechanism 500 as an example of a moving unit that moves the second binding tool 72 toward the first binding tool 71.

The moving mechanism 500 includes a rod-shaped threaded member 510 that extends in the vertical direction in FIG. 4, and the threaded member 510 is rotated in a circumferential direction by a drive motor (not illustrated) so that the second binding tool 72 moves toward the first binding tool 71.

In the present exemplary embodiment, an interlocking portion 600 that moves together with the second binding tool 72 is provided. In the present exemplary embodiment, the threaded member 510 meshes with the interlocking portion 600. In other words, the threaded member 510 is connected to the interlocking portion 600.

The moving mechanism 500 rotates the threaded member 510, which meshes with the interlocking portion 600, in the circumferential direction so that the second binding tool 72 moves toward the first binding tool 71.

More specifically, in the present exemplary embodiment, the threaded member 510 rotates in one circumferential direction when a drive motor (not illustrated) provided on the binder unit 52 is rotated in a forward direction.

Accordingly, the interlocking portion 600 and the second binding tool 72 move downward, and the second binding tool 72 moves toward the first binding tool 71. Thus, the binding process is performed.

When the binding process is completed, the drive motor is rotated in a reverse direction, so that the threaded member 510 is rotated in the opposite direction.

Accordingly, the interlocking portion 600 and the second binding tool 72 move upward. When the second binding tool 72 moves upward, the second binding tool 72 is separated from the first binding tool 71.

Although the threaded member 510 is used to move the second binding tool 72 in the present exemplary embodiment, the mechanism for moving the second binding tool 72 is not particularly limited, and a cam mechanism or a jack mechanism, for example, may also be used.

In addition, although the second binding tool 72 is moved in the present exemplary embodiment, the first binding tool 71 or both the first binding tool 71 and the second binding tool 72 may be moved.

In the present exemplary embodiment, the binder unit 52 is capable of passing the end guides 64 illustrated in FIG. 3.

More specifically, in the present exemplary embodiment, the maximum gap between the first binding tool 71 and the second binding tool 72 is greater than the height of the end guides 64. Accordingly, in the present exemplary embodiment, the binder unit 52 is capable of passing the end guides 64.

Figure 5:
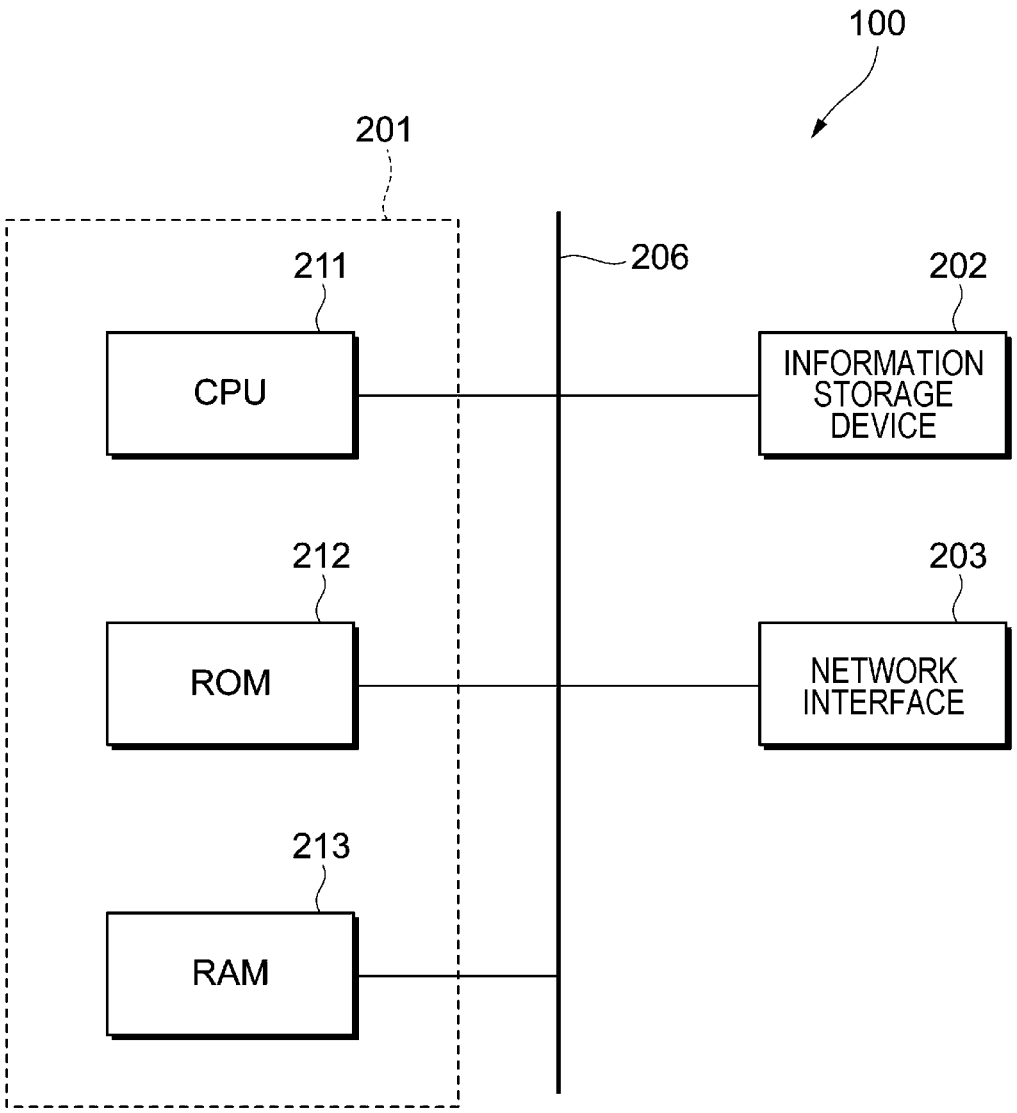
FIG. 5 illustrates the hardware structure of an information processing unit.

FIG. 5 illustrates the hardware structure of the information processing unit 100.

The information processing unit 100 includes a processing unit 201, an information storage device 202 that stores information, and a network interface 203 that enables communication through, for example, a local area network (LAN) cable.

The processing unit 201 is constituted by a computer.

The processing unit 201 includes a central processing unit (CPU) 211 as an example of a processor that performs various processes. The processing unit 201 also includes a read only memory (ROM) 212 in which software is stored and a random access memory (RAM) 213 used as a work area.

The information storage device 202 may be an existing device, such as a hard disk drive, a semiconductor memory, or a magnetic tape.

The processing unit 201, the information storage device 202, and the network interface 203 are connected to each other with a bus 206 and signal lines (not illustrated).

The programs performed by the CPU 211 may be provided to the information processing unit 100 in a state such that they are stored in a computer readable storage medium, such as a magnetic storage medium (for example, a magnetic tape or a magnetic disk), an optical storage medium (for example, an optical disc), a magneto-optical storage medium, or a semiconductor memory. The programs performed by the CPU 211 may also be provided to the information processing unit 100 through a communication system, such as the Internet.

Figure 6:
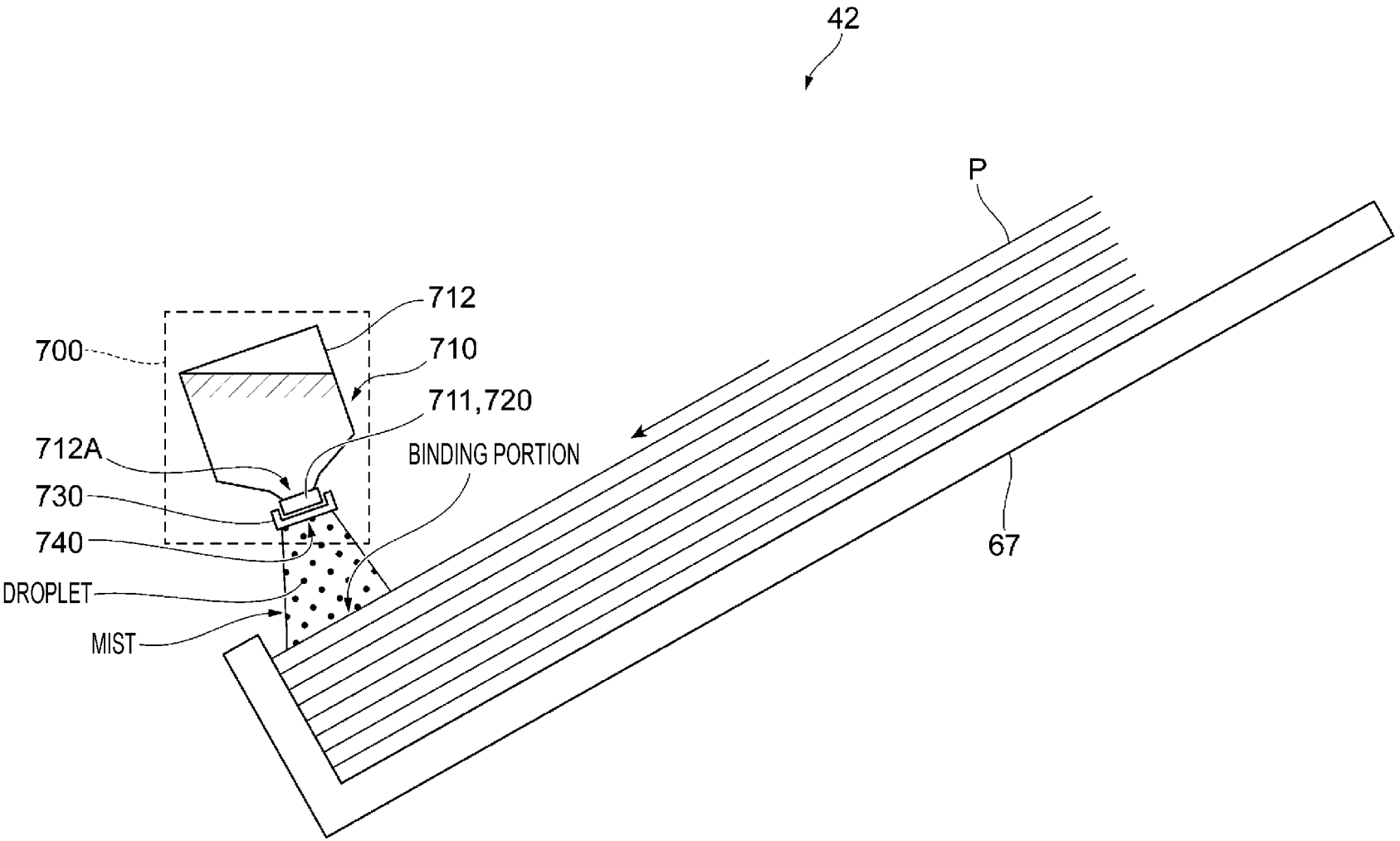
FIG. 6 illustrates a moisture supplying unit included in a moisture adjustment mechanism.

FIG. 6 illustrates the moisture supplying unit 710 included in the moisture adjustment mechanism 700. FIG. 6 is a view of the edge binding unit 42 in the direction shown by arrow VI when the moisture adjustment mechanism 700 is stopped at position (B) in FIG. 3.

The moisture supplying unit 710 according to the present exemplary embodiment includes an ultrasonic vibrator 711, and supplies moisture in the form of mist generated by vibration of the ultrasonic vibrator 711 to the binding portion.

The moisture in the form of mist may also be generated by a source other than the ultrasonic vibrator 711. More specifically, for example, the moisture supplying unit 710 may be provided with a mechanism with which moisture in the form of mist is generated by a negative pressure airflow created by pushing the moisture outward with pressure, and the moisture in the form of mist generated by the negative pressure airflow may be supplied to the binding portion.

The moisture supplying unit 710 includes a container 712 that contains water, which is an example of moisture. The container 712 has an opening 712A, and is oriented such that the opening 712A faces obliquely downward.

The moisture supplying unit 710 also includes a source 720 that is provided at the opening 712A in the container 712 and that generates moisture in the form of mist and a filter 730 that allows passage of droplets that are contained in the moisture in the form of mist generated at the source 720 and that have a size less than a predetermined size. In the example illustrated in FIG. 6, the source 720 is the ultrasonic vibrator 711.

The filter 730 allows passage of droplets that are contained in the moisture in the form of mist and that have a particle size of 40 μm or less. Accordingly, the moisture supplying unit 710 according to the present exemplary embodiment supplies moisture in the form of mist containing droplets having a particle size of 40 μm or less to the binding portion.

The filter 730 includes a mesh, which is an example of a member having plural through holes. In the present exemplary embodiment, the size of the through holes in the mesh is adjusted so that the filter 730 allows passage of droplets that are contained in the moisture in the form of mist and that have a particle size of 40 μm or less.

Thus, in the present exemplary embodiment, moisture in the form of mist containing droplets having a particle size of 40 μm or less is supplied to the binding portion.

In the present exemplary embodiment, the source 720 included in the moisture supplying unit 710 generates droplets having a particle size of 10 μm or more.

As a result, in the present exemplary embodiment, moisture in the form of mist containing droplets having a particle size of 10 μm to 40 μm is supplied to the binding portion.

Thus, when moisture is to be supplied to the binding portion, moisture in the form of mist containing droplets having a particle size of 10 μm to 40 μm may be supplied to the binding portion.

When the droplets contained in the moisture in the form of mist all have a particle size of 10 μm or less, the moisture is not easily supplied to the paper sheets P because the droplets do not easily fall and the moisture contained in the droplets is easily evaporated.

According to the findings of the inventors of the present disclosure, droplets having a size of 25 μm tend to travel a long distance and enable supply of moisture in the form of mist over a wide area.

In general, surfaces of the paper sheets P have recesses with a diameter of 30 μm to 50 μm, and droplets of moisture having a size of 50 μm or less may penetrate into the paper sheets P. When the droplets have a size of 40 μm or less, the moisture more easily penetrates into the paper sheets P.

Accordingly, in the present exemplary embodiment, as described above, the filter 730 that allows passage of droplets having a particle size of 40 μm or less is provided, so that moisture in the form of mist containing droplets having a particle size of 10 μm to 40 μm is supplied to the binding portion.

In other words, in the present exemplary embodiment, the filter 730 that restricts movement of droplets having a particle size of greater than 40 μm is provided, and moisture in the form of mist containing droplets having a particle size of 10 μm to 40 μm is supplied to the binding portion.

Another method for supplying moisture to the paper sheets P is to supply moisture by using, for example, an inkjet head.

To reliably discharge moisture from the inkjet head, it may be necessary to adjust the viscosity and surface tension of the moisture. In such a case, the device structure may become more complex, and the operator's workload may be increased.

More specifically, although it is convenient to use tap water as the moisture to be supplied to the paper sheets P, use of tap water along with the inkjet head may require adjustment of the viscosity and surface tension of the moisture. In such a case, the device may become more complex, and the workload of a user may be increased.

In contrast, when the moisture in the form of mist is generated by using the ultrasonic vibrator 711 or by a negative pressure airflow, the viscosity and surface tension of the moisture need not be adjusted, or only a small degree of adjustment is required.

When the inkjet head is used, the inkjet head needs to be disposed very close to the paper sheets P. In contrast, when the moisture in the form of mist is supplied to the paper sheets P, the moisture supplying unit 710 may be disposed at a location separated from the paper sheets P, and this provides higher flexibility in installation of the moisture supplying unit 710.

The adjustment of the viscosity and surface tension of the moisture may or may not be eliminated, and also when the moisture in the form of mist is generated by using the ultrasonic vibrator 711 or by a negative pressure airflow as in the present exemplary embodiment, the viscosity and surface tension of the moisture may be adjusted as necessary.

In the present exemplary embodiment, as illustrated in FIG. 6, the moisture supplying unit 710 has an outlet 740 from which the moisture in the form of mist is discharged. In the present exemplary embodiment, the outlet 740 is directed in a direction that is not directly downward or directly upward.

More specifically, the outlet 740 is directed in an obliquely downward direction. In this case, the moisture in the form of mist is supplied over a larger region than when the outlet 740 is directed directly downward or directly upward.

The outlet 740 may also be directed in a horizontal direction. Also in this case, the moisture in the form of mist is supplied over a larger region than when the outlet 740 is directed directly downward or directly upward.

Figure 7:
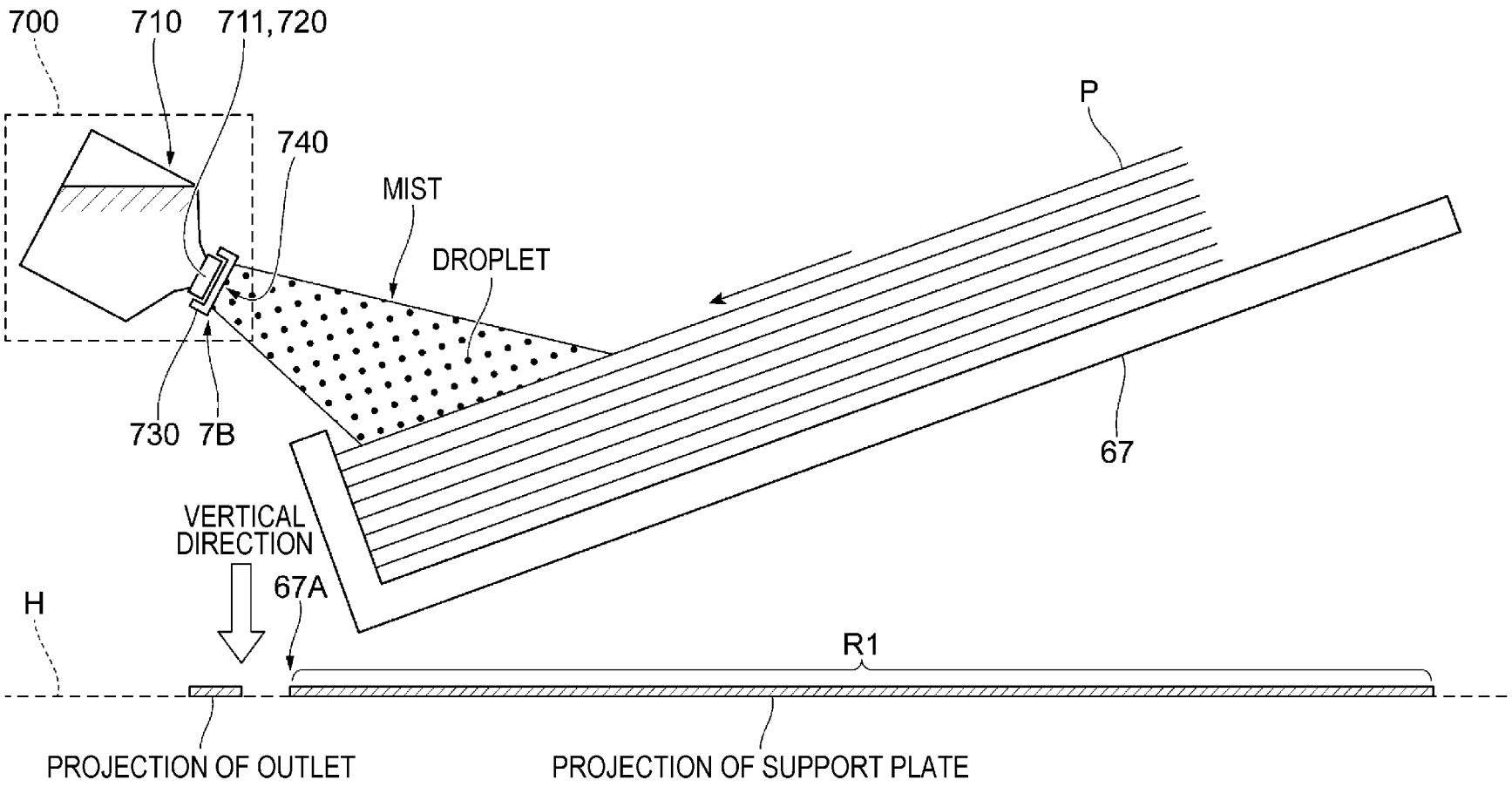
FIG. 7 illustrates another exemplary structure of an edge binding unit.

FIG. 7 illustrates another exemplary structure of the edge binding unit 42.

In this exemplary structure, the paper sheets P to which moisture is supplied are disposed at a location separated from a location directly below the outlet 740. In other words, in this exemplary structure, the support plate 67 that supports the paper sheets P is disposed at a location separated from the location directly below the outlet 740.

In this exemplary structure, when the outlet 740 and the support plate 67 are both projected downward in the vertical direction onto an imaginary plane H orthogonal to the vertical direction, the outlet 740 and the support plate 67 do not overlap.

The outlet 740 is positioned outside an outer peripheral edge 67A of the support plate 67 on the imaginary plane H, and moisture in the form of mist is discharged from the actual outlet 740 denoted by 7B toward a region R1 surrounded by the outer peripheral edge 67A on the imaginary plane H.

Also in this exemplary structure, the outlet 740 is directed in an obliquely downward direction to discharge the moisture in the form of mist in the obliquely downward direction, so that the moisture in the form of mist is supplied to the paper sheets P at a location separated from the location directly below the outlet 740.

Similar to the above-described example, the outlet 740 may be directed in a horizontal direction to discharge the moisture in the form of mist in the horizontal direction so that the moisture in the form of mist is supplied to the paper sheets P at a location separated from the location directly below the outlet 740.

When the moisture in the form of mist is discharged from the outlet 740, there is a possibility that the moisture will condense on and drip from the outlet 740. In such a case, when the paper sheets P are positioned at a location separated from the location directly below the outlet 740 as in the present exemplary embodiment, the moisture that drips from the outlet 740 does not reach the paper sheets P.

Figure 8:
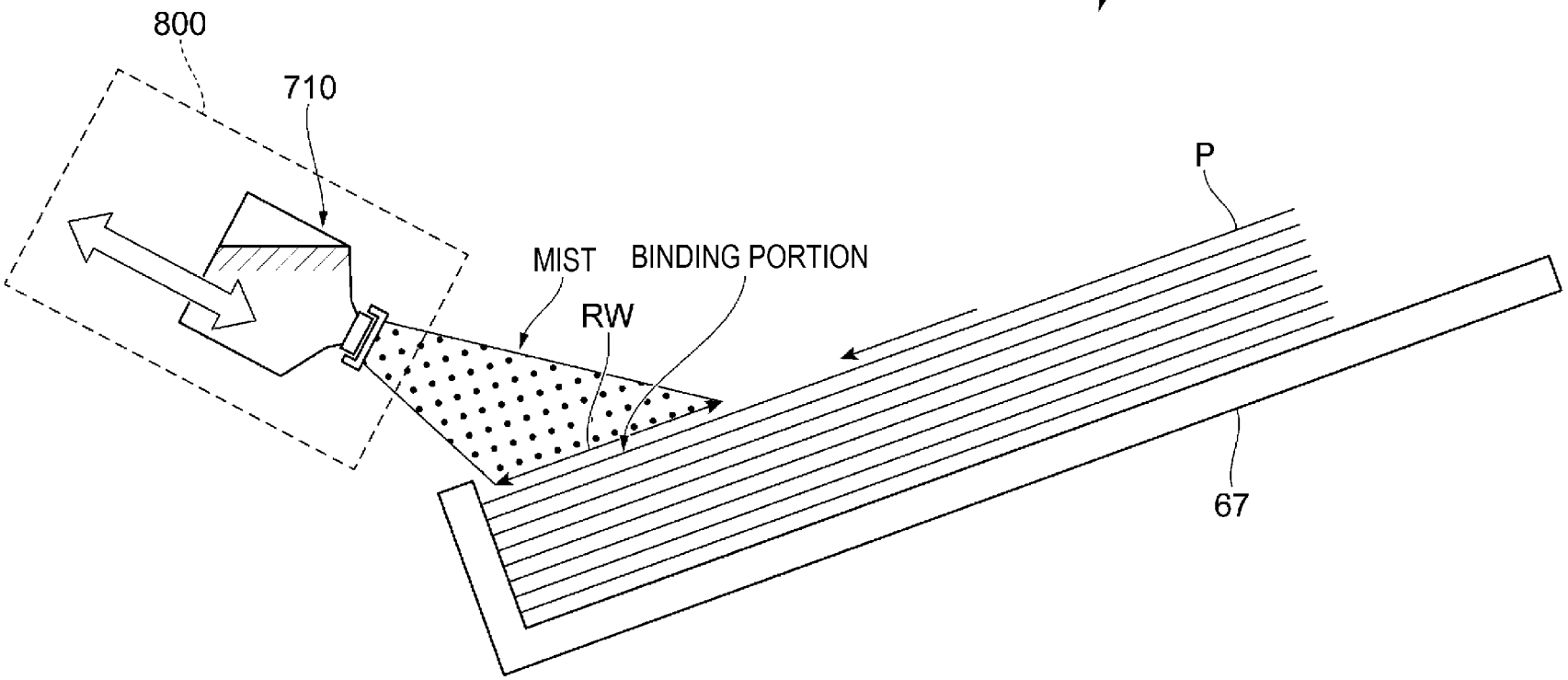
FIG. 8 illustrates another exemplary structure of an edge binding unit.

FIG. 8 illustrates another exemplary structure of the edge binding unit 42.

In the exemplary structure illustrated in FIG. 8, a moving mechanism 800 is provided as an example of a mover that moves the moisture supplying unit 710 toward and away from the binding portion.

The moving mechanism 800 may be a known technology, and is not particularly limited.

The moving mechanism 800 may be, for example, a mechanism including a rack gear. In such a case, the moisture supplying unit 710 is attached to the rack gear, and the rack gear is moved back and forth with a pinion gear so that the moisture supplying unit 710 moves toward and away from the binding portion.

Assuming that the moisture supplying unit 710 is movable toward and away from the binding portion, when the moisture supplying unit 710 is moved toward the binding portion, a region RW in which moisture is supplied to the paper sheets P is reduced. In this case, the amount of moisture supplied per unit area is increased.

In contrast, when the moisture supplying unit 710 is moved away from the binding portion, the region RW in which moisture is supplied to the paper sheets P is increased. In this case, the amount of moisture supplied per unit area is reduced.

The amount of moisture supplied per unit area may be increased or reduced in accordance with various factors, such as the type of the paper sheets P and the temperature in the binding process.

Although the amount of moisture supplied per unit area may be increased or reduced by changing the output of the moisture supplying unit 710, it may be difficult to change the output of the moisture supplying unit 710. In such a case, the amount of moisture supplied per unit area cannot be easily changed.

In the exemplary structure illustrated in FIG. 8, the amount of moisture supplied per unit area may be changed without changing the output of the moisture supplying unit 710.

Figure 9:
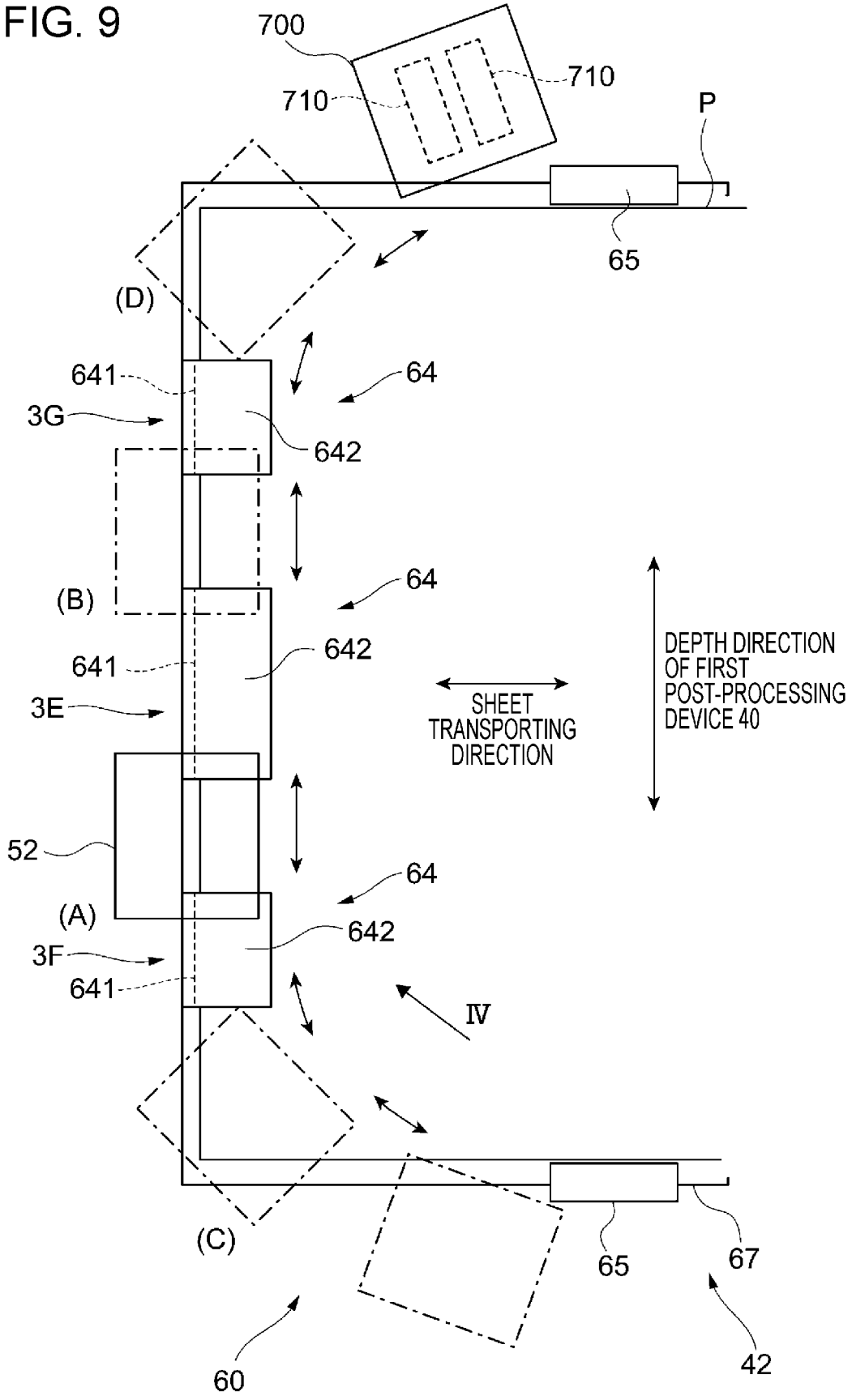
FIG. 9 illustrates another exemplary structure of an edge binding unit.

FIG. 9 illustrates another exemplary structure of the edge binding unit 42.

In the exemplary structure illustrated in FIG. 9, plural moisture supplying units 710 are provided. More specifically, in this exemplary structure, the movable moisture adjustment mechanism 700 includes plural moisture supplying units 710. More specifically, in this exemplary structure, the moisture adjustment mechanism 700 includes two moisture supplying units 710.

Although two moisture supplying units 710 are provided in the example illustrated in FIG. 9, the number of moisture supplying units 710 may be three or more.

Also in the exemplary structure illustrated in FIG. 9, the amount of moisture supplied per unit area may be changed without changing the output of each moisture supplying unit 710.

More specifically, in this exemplary structure, when the amount of moisture supplied to the binding portion, which is a portion to which moisture is supplied, is to be increased, the plural moisture supplying units 710 are activated.

When the amount of moisture supplied to the binding portion is to be reduced, a number of moisture supplying units 710 less than the number of moisture supplying units 710 activated to increase the amount of moisture supplied is activated; for example, one moisture supplying unit 710 is activated.

The structure illustrated in FIG. 9 is an example, and other structures may be employed.

Figure 10:
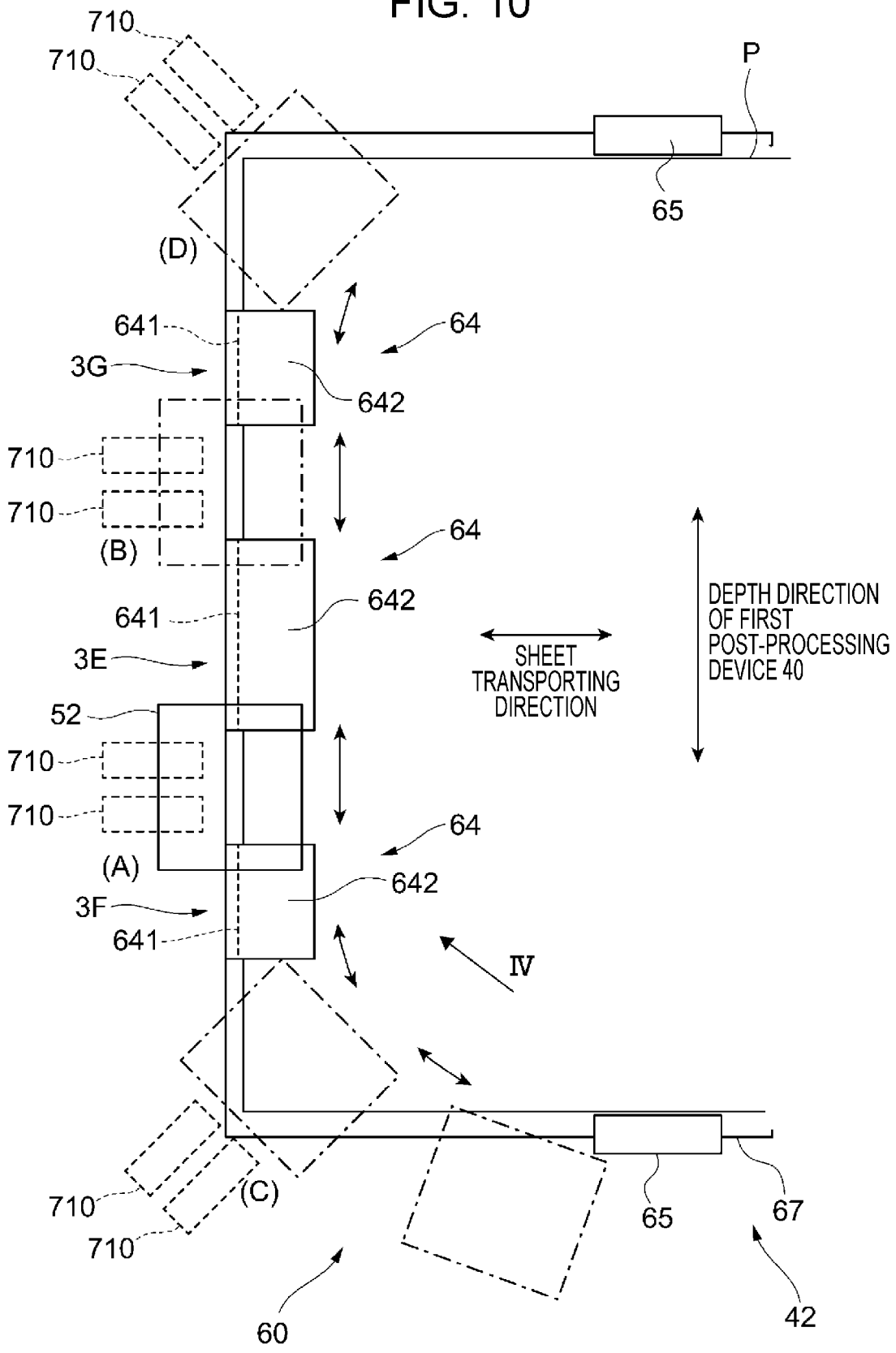
FIG. 10 illustrates another exemplary structure of an edge binding unit.

Four binding positions, which are position (A) to position (D) in FIG. 9, are set in advance in the present exemplary embodiment, and the plural moisture supplying units 710 may be provided at each of these four binding positions as illustrated in FIG. 10, which illustrates another exemplary structure of the edge binding unit 42.

In this case, when the amount of moisture supplied to the binding portion is to be increased at one of the four binding positions, the plural moisture supplying units 710 provided at this binding position are activated.

When the amount of moisture supplied to the binding portion is to be reduced at one of the binding positions, a number of moisture supplying units 710 less than the number of moisture supplying units 710 activated to increase the amount of moisture supplied is activated at this binding position; for example, one moisture supplying unit 710 is activated at this binding position.

When plural moisture supplying units 710 are provided for one binding portion, the plural moisture supplying units 710 may be included in one moisture adjustment mechanism 700 as illustrated in FIG. 9, or be provided at each binding position as illustrated in FIG. 10.

When moisture is supplied by one or more moisture supplying units 710, the amount of moisture supplied to the binding portion may be changed by, for example, changing the output of the or each moisture supplying unit 710 or changing the number of moisture supplying units 710 that are activated.

Alternatively, the amount of moisture supplied to the binding portion may be changed by changing the time for which a moisture supplying unit 710 is activated.

The process of changing the time for which the moisture supplying unit 710 is activated is performed by the CPU 211 (see FIG. 5), which is an example of a processor. The CPU 211 changes the time for which the moisture supplying unit 710 is activated to change the amount of moisture supplied to the binding portion.

More specifically, the CPU 211 increases the time for which the moisture supplying unit 710 is activated to increase the amount of moisture supplied to the binding portion, and reduces the time for which the moisture supplying unit 710 is activated to reduce the amount of moisture supplied to the binding portion.

For example, the amount of moisture supplied to the binding portion may be increased or reduced in accordance with, for example, the type of the paper sheets or the temperature in the binding process.

In such a case, when the amount of moisture supplied to the binding portion is to be increased, the CPU 211 increases the time for which the moisture supplying unit 710 is activated. When the amount of moisture supplied to the binding portion is to be reduced, the CPU 211 sets the time for which the moisture supplying unit 710 is activated to a time less than that for increasing the amount of moisture supplied to the binding portion.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

APPENDIX (((1))

A recording medium processing apparatus including:

a binder that performs a binding process on a recording medium; and a moisture supplier that supplies moisture in a form of mist to a binding portion of the recording medium, the binding portion being a portion subjected to the binding process performed by the binder.

(((2))

The recording medium processing apparatus according to (((1))), wherein the moisture in the form of mist supplied to the binding portion by the moisture supplier is generated by vibration of an ultrasonic vibrator.

(((3))

The recording medium processing apparatus according to (((1))), wherein the moisture in the form of mist supplied to the binding portion by the moisture supplier is generated by a negative pressure airflow created by pushing the moisture outward with pressure.

(((4))

The recording medium processing apparatus according to any one of (((1))) to (((3))), wherein the moisture in the form of mist supplied to the binding portion by the moisture supplier contains droplets having a particle size of 10 μm to 40 μm.

(((5))

The recording medium processing apparatus according to (((1))), wherein the moisture supplier includes:

a source that generates the moisture in the form of mist; and a filter that allows passage of droplets that are contained in the moisture in the form of mist generated by the source and that have a size less than a predetermined size.

(((6))

The recording medium processing apparatus according to (((5))), wherein the filter allows passage of droplets that are contained in the moisture in the form of mist and that have a particle size of 40 μm or less.

(((7))

The recording medium processing apparatus according to any one of (((1))) to (((6))), wherein the moisture supplier has an outlet from which the moisture in the form of mist is discharged, and wherein the outlet is directed in a direction that is not directly downward or directly upward.

(((8))

The recording medium processing apparatus according to (((7))), wherein the outlet is directed in a horizontal direction or an obliquely downward direction.

(((9))

The recording medium processing apparatus according to any one of (((1))) to (((6))), wherein the moisture supplier has an outlet from which the moisture in the form of mist is discharged, and wherein the recording medium to which the moisture is supplied is disposed at a location separated from a location directly below the outlet.

(((10))

The recording medium processing apparatus according to (((9))), wherein the moisture in the form of mist is discharged from the outlet in a horizontal direction or an obliquely downward direction so that the moisture in the form of mist is supplied to the recording medium disposed at the location separated from the location directly below the outlet.

(((11))

The recording medium processing apparatus according to any one of (((1))) to (((10))), further including:

a mover that moves the moisture supplier toward and away from the binding portion.

(((12))

The recording medium processing apparatus according to any one of (((1))) to (((11))), wherein the moisture supplier is one of a plurality of moisture suppliers that are provided.

(((13))

The recording medium processing apparatus according to any one of (((1))) to (((12))), further including:

a processor configured to change an amount of the moisture supplied to the recording medium by the moisture supplier, wherein the processor is configured to change the amount of the moisture supplied to the recording medium by changing a time for which the moisture supplier is activated.

(((14))

An image forming system including:

an image forming apparatus that forms an image on a recording medium; and a recording medium processing apparatus that performs a binding process on the recording medium on which the image is formed by the image forming apparatus, wherein the recording medium processing apparatus includes the recording medium processing apparatus according to any one of (((1))) to (((13))).

What is claimed is:

1. A recording medium processing apparatus comprising:

a binder that performs a binding process on a recording medium; and a moisture supplier that supplies moisture in a form of mist to a binding portion of the recording medium, the binding portion being a portion subjected to the binding process performed by the binder, a processor configured to change an amount of the moisture supplied to the recording medium by the moisture supplier, wherein the processor is configured to change the amount of the moisture supplied to the recording medium by changing a time for which the moisture supplier is activated.

2. The recording medium processing apparatus according to claim 1, wherein the moisture in the form of mist supplied to the binding portion by the moisture supplier is generated by vibration of an ultrasonic vibrator.

3. The recording medium processing apparatus according to claim 1, wherein the moisture in the form of mist supplied to the binding portion by the moisture supplier is generated by a negative pressure airflow created by pushing the moisture outward with pressure.

4. The recording medium processing apparatus according to claim 1, wherein the moisture in the form of mist supplied to the binding portion by the moisture supplier contains droplets having a particle size of 10 μm to 40 μm.

5. The recording medium processing apparatus according to claim 1, wherein the moisture supplier includes:

a source that generates the moisture in the form of mist; and a filter that allows passage of droplets that are contained in the moisture in the form of mist generated by the source and that have a size less than a predetermined size.

6. The recording medium processing apparatus according to claim 5, wherein the filter allows passage of droplets that are contained in the moisture in the form of mist and that have a particle size of 40 μm or less.

7. The recording medium processing apparatus according to claim 1, wherein the moisture supplier has an outlet from which the moisture in the form of mist is discharged, and wherein the outlet is directed in a direction that is not directly downward or directly upward.

8. The recording medium processing apparatus according to claim 7, wherein the outlet is directed in a horizontal direction or an obliquely downward direction.

9. The recording medium processing apparatus according to claim 1, wherein the moisture supplier has an outlet from which the moisture in the form of mist is discharged, and wherein the recording medium to which the moisture is supplied is disposed at a location separated from a location directly below the outlet.

10. The recording medium processing apparatus according to claim 9, wherein the moisture in the form of mist is discharged from the outlet in a horizontal direction or an obliquely downward direction so that the moisture in the form of mist is supplied to the recording medium disposed at the location separated from the location directly below the outlet.

11. The recording medium processing apparatus according to claim 1, further comprising:

a mover that moves the moisture supplier toward and away from the binding portion.

12. The recording medium processing apparatus according to claim 1, wherein the moisture supplier is one of a plurality of moisture suppliers that are provided.

13. An image forming system comprising:

an image forming apparatus that forms an image on a recording medium; and a recording medium processing apparatus that performs a binding process on the recording medium on which the image is formed by the image forming apparatus, wherein the recording medium processing apparatus includes the recording medium processing apparatus according to claim 1.

14. An image forming system comprising:

an image forming apparatus that forms an image on a recording medium; and a recording medium processing apparatus that performs a binding process on the recording medium on which the image is formed by the image forming apparatus, wherein the recording medium processing apparatus includes the recording medium processing apparatus according to claim 2.

15. An image forming system comprising:

an image forming apparatus that forms an image on a recording medium; and a recording medium processing apparatus that performs a binding process on the recording medium on which the image is formed by the image forming apparatus, wherein the recording medium processing apparatus includes the recording medium processing apparatus according to claim 3.

16. An image forming system comprising:

an image forming apparatus that forms an image on a recording medium; and a recording medium processing apparatus that performs a binding process on the recording medium on which the image is formed by the image forming apparatus, wherein the recording medium processing apparatus includes the recording medium processing apparatus according to claim 4.

17. An image forming system comprising:

an image forming apparatus that forms an image on a recording medium; and a recording medium processing apparatus that performs a binding process on the recording medium on which the image is formed by the image forming apparatus, wherein the recording medium processing apparatus includes the recording medium processing apparatus according to claim 5.

18. An image forming system comprising:

an image forming apparatus that forms an image on a recording medium; and a recording medium processing apparatus that performs a binding process on the recording medium on which the image is formed by the image forming apparatus, wherein the recording medium processing apparatus includes the recording medium processing apparatus according to claim 6.

19. An image forming system comprising:

an image forming apparatus that forms an image on a recording medium; and a recording medium processing apparatus that performs a binding process on the recording medium on which the image is formed by the image forming apparatus, wherein the recording medium processing apparatus includes the recording medium processing apparatus according to claim 7.

* * * * *